United States Patent [19]

Nikolic et al.

[11] 3,933,976

[45] Jan. 20, 1976

[54] NICKEL-COBALT SEPARATION

[75] Inventors: Cvetko B. Nikolic, Golden; Robert S. Rickard, Lakewood; Weldon P. Zundel, Golden, all of Colo.

[73] Assignee: Amax Inc., New York, N.Y.

[22] Filed: Feb. 8, 1974

[21] Appl. No.: 441,180

[52] U.S. Cl. ..... 423/144; 423/145; 423/150; 75/119; 75/5 A

[51] Int. Cl.[2] ..... C01G 51/00; C01G 53/00

[58] Field of Search ..... 423/139, 144, 143, 145, 423/150; 75/103; 204/96

[56] References Cited

UNITED STATES PATENTS

| | | | |
|---|---|---|---|
| 446,495 | 1/1892 | Herrenschmidt | 423/592 |
| 2,415,665 | 2/1947 | Wallis et al. | 423/592 |
| 2,793,936 | 5/1957 | Voos | 423/150 |
| 3,489,664 | 1/1970 | Popat et al. | 204/96 |
| 3,751,558 | 8/1973 | Crnojevich et al. | 423/144 |
| 3,806,591 | 4/1974 | Lever et al. | 423/592 |

*Primary Examiner*—Oscar R. Vertiz
*Assistant Examiner*—Brian E. Hearn
*Attorney, Agent, or Firm*—Kasper T. Serijan; Eugene J. Kalil

[57] ABSTRACT

A method is provided for enriching nickel in a nickel-cobalt solution to a nickel-to-cobalt ratio of over 2000:1, wherein an aliquot portion of the solution is removed, the nickel precipitated from said aliquot portion in the nickelous state, the nickelous precipitate thereafter oxidized to the nickelic state and the oxidized nickel precipitate then mixed with the remaining nickel-cobalt solution to oxidize the cobalt therein to the cobaltic state which precipitates from the solution, thereby highly enriching the solution in nickel.

2 Claims, 3 Drawing Figures

NICKEL-COBALT SEPARATION

This invention relates to the hydrometallurgy of nickel and cobalt and to a method for producing nickel solutions very low in cobalt content and, in particular, to a method for separating nickel from cobalt in nickel-cobalt solutions, and the like, especially solutions obtained in the leaching of nickel-containing materials, for example, leached oxidic nickel and cobalt-containing materials, such as ores, oxidized sulfide concentrates, hydroxide concentrates, and the like.

BACKGROUND OF THE INVENTION

Nickel and cobalt are generally found together in natural-occurring minerals and, because conventional ore dressing methods do not effect a separation of the two, both metals generally appear together in solutions resulting from the leaching of nickel and cobalt-containing materials, such as leached oxide ores, oxidized sulfide concentrates and the like.

In recent years, several hydrometallurgical methods have been proposed for the recovery of nickel and/or cobalt from lateritic limonitic ores. One method, in particular, resides in using aqueous sulfuric acid as the leachant at high temperature under elevated pressure. The raw ore is prepared in a finely divided state and a slurry formed at about 10 percent to 20 percent solids which is thereafter concentrated by settling and decanting in thickeners to produce an underflow having a concentration of about 30 percent to 50 percent solids. The concentrated slurry is heated in an autoclave by means of direct high pressure steam to a high temperature at which the leaching or other recovery treatment is carried out, usually above 400°F (205°C), e.g. about 475°F (246°C) at a pressure of about 525 psig in the presence of sulfuric acid to solubilize the nickel and cobalt present in the slurried ore. Following leaching in the autoclave, the leached pulp is cooled and preferably washed by countercurrent decantation and the resulting acid leach liquor then treated with a neutralizing agent [$Mg(OH)_2$, coral mud, or the like] to raise the pH to, for example, 2.5 to 2.8 for the sulfide precipitation of nickel and cobalt. The leach liquor is brought to a temperature of about 250° F (122°C) and the nickel and cobalt precipitated as sulfides with $H_2S$ at pressures of up to about 150 psig, using nickel sulfide as seed material.

The sulfide precipitate is washed and thickened to about 65 percent solids and then oxidized at about 350°F (177°C) and a pressure of about 700 psig in an autoclave in 1 percent sulfuric acid. Ammonia is added as a neutralizing agent to the nickel-cobalt solution to raise the pH to a level (e.g. 5.3) using air as an oxidant, to precipitate any iron, aluminum or chromium carried over as an impurity during leaching. After separating the solution from the precipitate, any copper, lead or zinc present therein is removed by precipitation as a sulfide, using $H_2S$ as the precipitant, the solution being first adjusted with acid to lower the pH to about 1.5. The sulfide precipitate is then separated from the solution and the solution then passed on to the nickel separation step.

Many methods have been proposed for the separation of nickel from cobalt contained in said aqueous solution. In one method, the solution is adjusted with ammonia to prepare it for the recovery of metallic nickel. The adjusted nickel feed solution containing about 40 to 50 grams per liter of nickel and some cobalt is reduced with hydrogen in an autoclave at about 375°F (190°C) and 650 psig using nickel powder as seed material, the barren liquor remaining going to cobalt recovery using known methods. However, some of the cobalt appears in the reduced nickel product.

Other methods proposed and/or commercially used for separating cobalt from nickel include cobalt sulfide precipitation from ammonia-ammonium carbonate solutions, cobalt separation from aqueous sulfuric acid solutions by means of nickelic hydroxide, and the separation of cobalt from nickel using the pentammine process described in U.S. Pat. Nos. 2,767,053 and 2,767,054, the cobalt being thereafter preferentially recovered in the metallic state by hydrogen reduction. This method, in particular, involves forming a solution containing cobaltic pentammine and nickelous ammine by adding an amount of ammonia sufficient to provide 5 mols of ammonia for each mol of cobaltic ion and 5 mols of ammonia for each mol of nickelous ion. The solution is oxidized with oxygen and then acidified with $H_2SO_4$ to a pH of at least about 4 to produce a nickel-bearing precipitate in the form of a nickel-ammonium double salt.

While the foregoing methods provided an acceptable nickel produce, provided the end use tolerated the presence of cobalt in the nickel, these methods in and of themselves had certain limitations insofar as the production of a pure nickel product was concerned.

For example, the recovery of nickel by the hydrogen reduction of nickel-cobalt solutions was not selective enough to meet new specification requirements for high purity nickel. The sulfide and the pentammine precipitation processes are generally limited to specific nickel-cobalt bearing solutions, the sulfide precipitation method generally requiring the use of significant amounts of a sulfidizing agent (e.g. $H_2S$). The nickelic hydroxide procedure is quite expensive and generally requires considerable amounts of caustic soda and oxidizing agents and has a very slow filtration rate. Both the nickelic hydroxide and the sulfide precipitation processes usually result in significant loss of nickel together with the precipitated cobalt in that the cobalt-containing precipitate contains more nickel than cobalt.

The present invention provides an improved method of separating cobalt from nickel-cobalt solutions.

OBJECTS OF THE INVENTION

It is thus an object of this invention to provide an improved method for separating nickel from nickel and cobalt-bearing solutions, wherein the nickel-containing product produced has a very high nickel-to-cobalt ratio.

Another object is to provide an economical hydrometallurgical method for the separation of nickel from cobalt, wherein the nickel-to-cobalt ratio of the resulting nickel-containing product is over 2000:1 and ranges up to 10,000:1 and higher.

These and other objects will more clearly appear when taken in conjunction with the following disclosure and the accompanying drawing, wherein.

STATEMENT OF THE INVENTION

Figure 1:
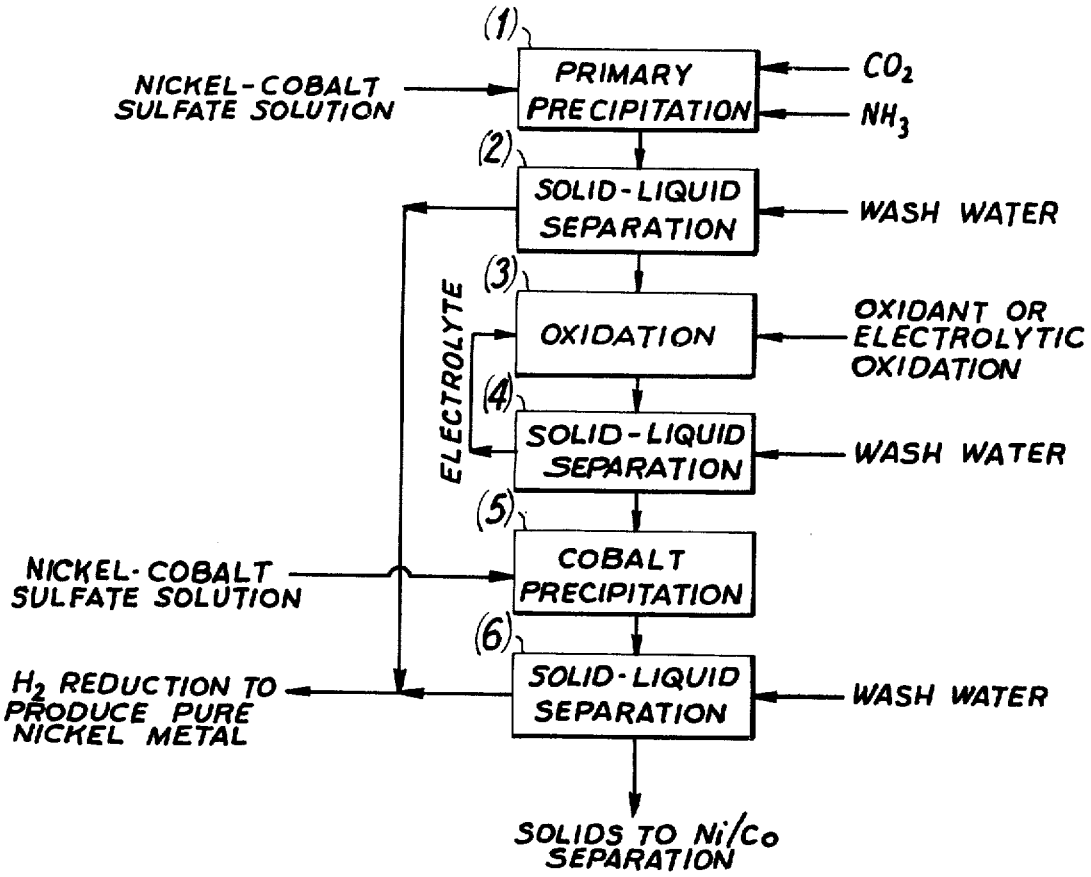
FIG. 1 is one example of a flow sheet for carrying out the objects of the invention.

Stating it broadly, a method of producing a nickel-rich solution from nickel-cobalt solutions containing nickelous and cobaltous ions is provided which comprises, providing a mainstream nickel-cobalt solution in which the nickel-to-cobalt ratio ranges from about 5:1 to 200:1, removing an aliquot portion of said nickel-cobalt solution from said mainstream, said aliquot portion containing enough nickel which, when oxidized to the nickelic state, is at least sufficient to oxidize the cobalt in the mainstream to the cobaltic state, precipitating said nickel from said aliquot portion as a nickelous precipitate by the addition of a precipitating agent selected from the group consisting of $CO_2$ and $NH_3$ and mixtures thereof, oxidizing said nickelous precipitate to the nickelic state, separating said oxidized nickel precipitate from solution, and contacting the mainstream solution with said oxidized precipitate to oxidize cobaltous ions in said solution to the cobaltic state and thus precipitate the cobalt from solution and reduce the nickelic ion to the nickelous, whereby the nickel in the mainstream solution is enriched substantially relative to the cobalt to provide a nickel:cobalt ratio in said solution of generally over 2000:1.

The foregoing method is novel in that it is very selective to the production of high purity nickel. The process is very easy to control and to operate and, moreover, the operating costs are low. Also, very high filtration rates are obtained for substantially all the precipitates involved in the steps of the process. In a preferred aspect of the invention, the crystallinity of the solid phases formed during precipitation can be controlled to provide markedly improved filterability. The cobalt concentrate obtained during the precipitation of cobalt generally exhibits a nickel-to-cobalt ratio of about 2.5:1 to 3:1 which can range to as high as 10:1, and the separation of nickel and cobalt from the cobalt precipitate or concentrate is made possible through the difference in valence states of the nickel and cobalt, the valence of nickel being +2 (nickelous) and the valence of cobalt being +3 (cobaltic).

In this connection, reference is made to copending application Ser. No. 441,179 filed of even date herewith in the names of the same inventors.

DETAIL ASPECTS OF THE INVENTION

As stated hereinabove, in carrying out the invention, an aliquot portion of the mainstream solution, e.g. a nickel-cobalt sulfate solution, is removed for the precipitation of nickel.

In one embodiment, about 13.5 percent by volume of the mainstream solution is removed and enough ammonia added to obtain a solution containing about 1 to 2 mols of $NH_3$ to one mol of nickel. Then, $CO_2$ is bubbled through the solution to precipitate about 50 percent of the nickel and over 98 percent of the cobalt. The primary "carbonate" precipitate obtained by this method is easy to filter and also can be filtered rapidly. Depending on the conditions of the system, the "carbonate" composition may vary between hydrated nickel oxide through a basic nickel carbonate to a relatively pure nickel carbonate. The aliquot portion of solution is predetermined to provide sufficient nickel precipitate to oxidize cobaltous ions in the remaining portion of the mainstream solution to cobaltic ions.

The aforementioned primary nickel carbonate precipitate is then oxidized, either by means of a strong oxidizing agent such as NaOCl, $CaOCl_2$, ozone and $(NH_4)_2S_2O_8$ or by electrolysis. The nickelic precipitate after filtering and washing is then contacted with the remaining mainstream solution to oxidize the cobaltous ion to cobaltic as follows:

$$Ni^{+3}(solid)+Co^{+2}(aq.) \quad Co^{+3}(solid) + Ni^{+2}(aq.)$$

The nickel goes into solution as the cobalt is oxidized and comes out of solution as a cobaltic precipitate containing some nickel.

The treated mainstream solution exhibits high nickel-to-cobalt ratios of substantially over 2000:1 and up to 10,000:1 and higher.

In another embodiment, the aforementioned aliquot portion of the mainstream solution is heated to a temperature of about 75°C to 80°C and ammonia added to provide a molar ratio of $NH_3$ to Ni of about 1.6:1 to 4:1 and preferably between about 1.6:1 to 2.5:1. The ammoniacal solution is kept at the foregoing temperature for about 30 to 60 minutes. About 50 percent of nickel and 98 percent of cobalt is precipitated.

When the precipitate is oxidized with NaOCl, for example, the primary precipitate is first filtered from its mother liquor. The filtrate remaining contains about 50 percent of the initial nickel content and is treated for nickel recovery with the subsequently purified mainstream. The precipitate is oxidized with NaOCl at 80°C for 30 minutes to form nickelic oxide. The precipitate has a pseudomorphic crystalline structure and filters easily. Any chloride ions in the precipitate are effectively removed by washing.

Where ammonium persulfate is used as the oxidant, filtration is not required since the reaction product is ammonium sulfate. After the cobalt has been precipitated from the aliquot portion of the mother liquor, the resulting pulp is maintained at 80°C for about 15 to 30 minutes after the ammonium persulfate is added. The oxidized precipitate is easily filtered from the solution and washed of free ammonium ions.

Electrolytic oxidation is carried out as follows: nickel "carbonate" is precipitated from solution as described hereinbefore. However, electrolytic oxidation may also be employed on ammonia precipitates without carbonates. The carbonate is filtered and washed and slurried in a sodium carbonate solution containing 70 gpl (grams per liter) $Na_2CO_3$ (anhydrous) and oxidized in an electrolytic cell. The cell comprises a pair of electrodes, the anode being made of sheet nickel and the cathode of iron wire mesh. A potential of 3.2 volts is employed, the current density being about 140 amps/square meter. A retention time of about 6 to 8 hours has been found satisfactory, with a power consumption of about 0.87KW hrs/lb.

The oxidized precipitate produced by any of the foregoing methods is introduced into the mainstream solution and the mixture maintained at about 75° to 80°C for 1 to 3 hours. The cobalt in solution is oxidized and precipitated out of solution, the oxidized nickel precipitate being, in turn, reduced and dissolved in the mainstream solution. The cobalt precipitate is easily filtered, the precipitate having a Ni:Co ratio of about 2:1 to 4:1. This precipitate can be further treated for nickel-cobalt separation directly or after acid digestion to produce an upgraded cobalt concentrate containing 3:1 to 5:1 of cobalt-to-nickel.

The flow sheet of the process will be apparent by referring to FIG. 1 of the drawing in which primary precipitation is carried out at Step (1) by adding $CO_2$ and $NH_3$ to the mainstream nickel-cobalt sulfate solution to form a carbonate precipitate containing nickel and cobalt, the solution and precipitate being subjected to solid-liquid separation at Step (2), the precipitate being washed with wash water. The nickelous precipitate is oxidized to nickelic oxide at Step (3). The solution and oxidized nickel precipitate are subjected to solid-liquid separation at Step (4) including the step of washing and the mainstream solution mixed with the oxidized precipitate to precipitate the cobalt as a cobaltic precipitate at Step (5).

The solution is separated from the precipitate at Step (6), with the solution going to hydrogen reduction to form pure nickel powder, the cobalt precipitate going to Ni/Co separation.

As illustrative of the advantages of the invention, the following example is given:

EXAMPLE 1

A part of a mainstream nickel-cobalt sulfate solution having a pH of about 5 to 6 was treated with concentrated $NH_4OH$ to provide an $NH_3$/Ni molar ratio of about 1.6:1. Carbon dioxide gas was then bubbled through the solution at room temperature for about 30 minutes. About 30 percent of the nickel and 95 percent of the cobalt precipitated. The precipitate was easily filterable and was separated from the solution and washed with water. The filtrate had a Ni:Co ratio of 1220:1. The precipitate was then oxidized with a 5 percent NaOCl solution for about 30 minutes at 75°C and a pH of about 6 to 7. A black oxidized precipitate was obtained which filtered rapidly and was washed free of chloride ions.

The oxidized product was then mixed with the remainder of the mainstream nickel-cobalt sulfate solution and the cobalt in the solution oxidized at 75°C and a pH of 5.5 at various times for each oxidized product. The cobalt oxidation was determined at 0, 30, 60 and 90 minutes and the Ni/Co ratio of the filtrate measured for each of the foregoing times. The results obtained are illustrated in FIG. 2.

Figure 2:
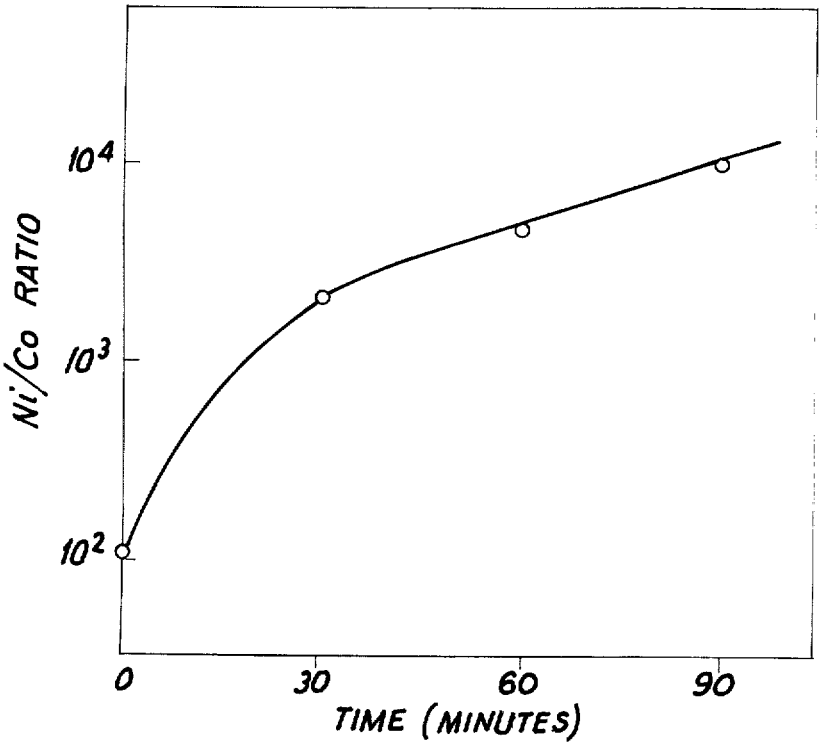
FIG. 2 is a curve showing the ratio of Ni/Co in the solution as a function of the time of oxidation and precipitation of cobalt from said solution.

As will be noted from FIG. 2, after 30 minutes of treatment, the mainstream solution with the oxidized product or precipitate, the resulting filtrate had a Ni/Co ratio of over 2000:1 and reached 10,000:1 after 90 minutes of treatment.

In the cobalt oxidation-precipitation step, it was observed that a high pH of about 6.2 in the feed solution prevents dissolution of the reduced nickel precipitate. Since all of the reduced nickel in the precipitate does not dissolve, selective leaching may be resorted to in order to separate Ni(II) from Co(III). For example, when the primary cobalt precipitate was leached with dilute sulfuric acid solution at a pH of 3.9 and a temperature of 90°C, a solution was obtained containing a Co/Ni ratio of 30:1 and a secondary cobalt precipitate concentrate with a Co/Ni ratio of 2.4:1. The solution from the digestion step can be recycled to the mainstream or to the nickel carbonate precipitation step.

Figure 3:
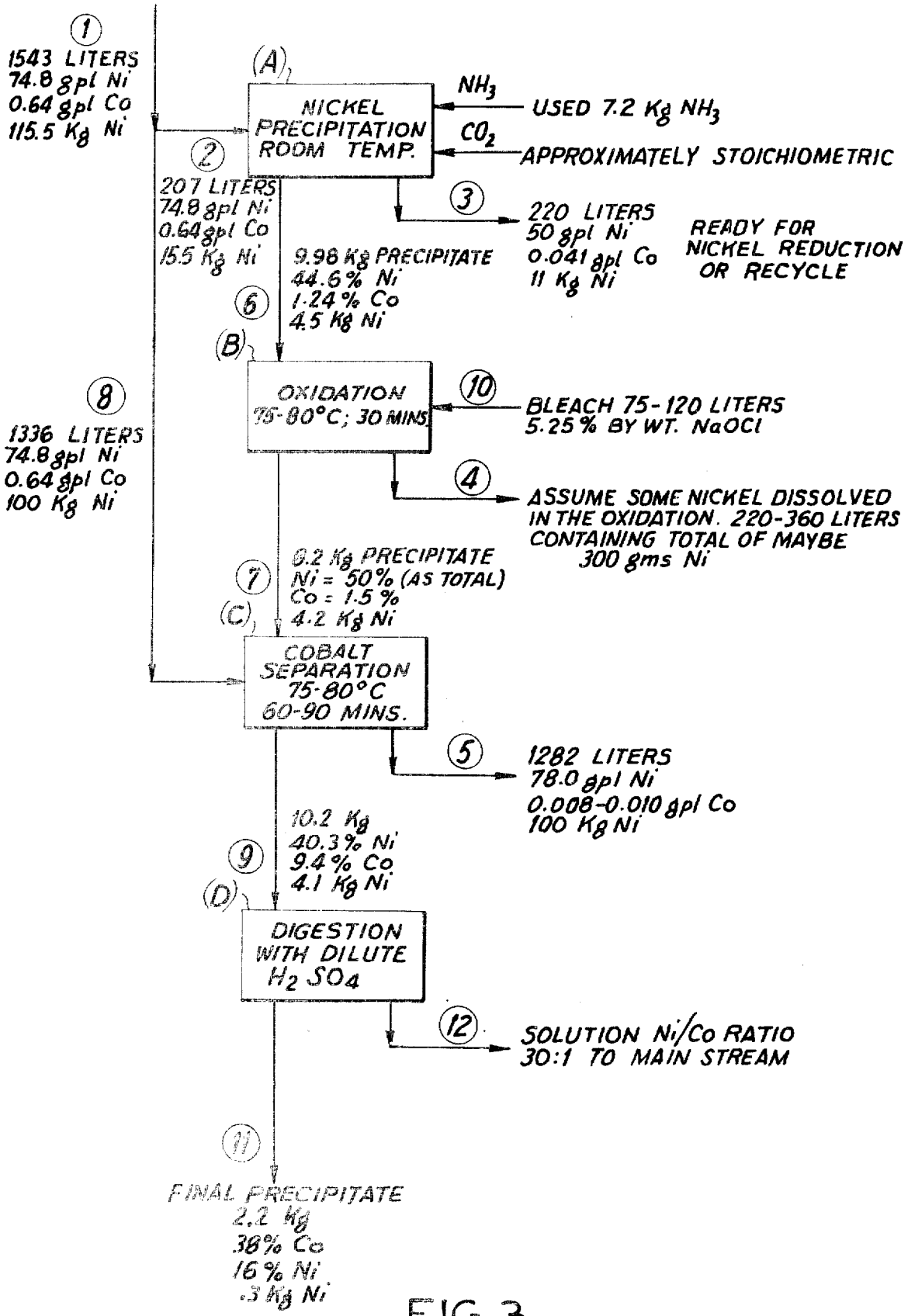
FIG. 3 is a detailed example of a material balance in the form of a flow sheet in carrying out one method of the invention.

FIG. 3 of the drawing is a detailed example of a material balance in the form of a flow sheet showing results obtained with 1,543 liters of mainstream solution (Stream 1) containing 74.8 gpl Ni, 0.64 gpl Co (Ni/Co ratio about 116:1), the total nickel content being about 115.5 Kg.

An aliquot portion of about 13.4 percent by volume of Stream 1 is removed as Stream 2 for precipitation of nickel at Step (A) by the addition of 7.2 Kg $NH_3$ and approximately a stoichiometric amount of $CO_2$. The resulting precipitate is separated as Stream 6 to go to oxidation at Step (B), the filtrate or Stream 3 comprising 220 liters containing 50 gpl Ni, 0.041 gpl Co (11 Kg total of Ni) going to either nickel reduction or to recycle.

The precipitate going to Step (B) weighs about 9.98 Kg and contains 44.6 percent Ni, 1.24 percent Co and contains a total of 4.5 Kg of Ni.

The foregoing precipitate is oxidized at about 75°–80°C for 30 minutes using about 75 to 120 liters of 5.25 percent by weight of a NaOCl solution referred to as Stream 10. It is assumed that some nickel dissolves during oxidation and after washing about 220 to 360 liters are obtained which may contain a total of 300 grams of nickel.

The oxidized precipitate referred to as Stream 7 weighs about 8.2 Kg and contains 50 percent nickel and 1.5 percent cobalt, the total contained nickel being 4.2 Kg. The precipitate is passed on to cobalt separation Step (C) together with the remaining mainstream, that is, Stream 8, which comprises 1,336 liters containing 74.8 gpl Ni, 0.64 gpl Co, the total nickel content being about 100 Kg. The oxidized precipitate and solution are maintained at 75° to 80°C for a residence time of about 60 to 90 minutes, such that the cobalt in Stream 8 is oxidized out as a cobaltic precipitate, Stream 5 being produced comprising 1,282 liters of solution containing 78 gpl Ni and 0.008 to 0.01 gpl Co, at a very high Ni/Co ratio of about 7800, the total amount of nickel being about 100 Kg or about 87 percent of the starting nickel solution.

The precipitate (Stream 9) weighs about 10.2 Kg and contains 40.3 percent Ni, 9.4 percent Co, the total amount of nickel being about 4.1 Kg. This precipitate is digested at Step (D) with dilute $H_2SO_4$ to provide a solution having a Ni/Co ratio of about 30:1 which is preferably recycled to the mainstream solution.

The final precipitate (Stream 11) after digestion weighs about 2.2 Kg and contains 38 percent Co, 16 percent Ni, with the total nickel content amounting to about 0.3 Kg.

Summarizing the foregoing, the invention provides a method of separating nickel from cobalt contained in nickel-cobalt sulfate solutions in which the Ni/Co ratio ranges from about 5:1 to 200:1 and, more preferably, from about 100:1 to 160:1.

A portion of the foregoing solution is taken and the nickel is precipitated therefrom in one of two ways as follows as a nickelous precipitate:

1 $CO_2$ and $NH_3$ are added to the solution, the amount of $CO_2$ being at least stoichiometric to precipitate nickel carbonate. The amount of $NH_3$ is sufficient to provide in the solution an $NH_3$/Ni mol ratio of about 1.5:1 to 2.5:1, with the pH ranging from about 7 to 7.5. The precipitate is thereafter oxidized to nickelic oxide as described herein, the oxidation being carried out at a temperature above 15°C, for example, 25°C to 30°C for electrolytic oxidation and about 60°C to 90°C and preferably about 75°C to 80°C for chemical oxidation.

The oxidized precipitate is washed and then mixed with the remainder of the solution at over 50°C to oxidize the cobaltous ion to cobaltic and precipitate it from solution, leaving a solution in which the Ni/Co ratio ranges over 2000:1 and up to 10,000:1 and higher.

2 In the other method, $NH_3$ alone is added to the aliquot portion of the solution to precipitate nickelous hydroxide, the amount of $NH_3$ added being sufficient to form an $NH_3$/Ni mol ratio of about 1.6:1 to 4:1, preferably 1.6:1 to 2.5:1 at a temperature over 50°C, or about 60°C to 90°C, preferably 75°C to 85°C, the pH of the solution ranging from about 7 to 8.

The precipitate is then oxidized to the nickelic state and used to oxidize the cobaltous ion to cobaltic in the main solution so as to precipitate the cobalt from the solution and provide a solution enriched in nickel relative to the cobalt content, that is, a Ni/Co mol ratio over 2000:1 and up to 10,000:1 and higher.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A method of producing a nickel-rich solution from nickel-cobalt solutions containing nickelous and cobaltous ions which comprises, providing a mainstream nickel-cobalt solution in which the nickel-to-cobalt ratio ranges from about 5:1 to about 200:1, removing an aliquot portion of said nickel-cobalt solution from said mainstream, said aliquot portion containing enough nickel which when oxidized to the nickelic state is at least sufficient to oxidize subsequently the cobalt in the mainstream to the cobaltic state, precipitating said nickel from said aliquot portion as a nickelous precipitate by adding $NH_3$ sufficient to provide in the solution an $NH_3$/Ni mol ratio of about 1.5:1 to 2.5:1 with the pH ranging from about 7 to 7.5 and by bubbling $CO_2$ through the solution to produce an easily filterable nickelous carbonate precipitate containing cobalt, oxidizing said nickelous precipitate to the nickelic state, separating said oxidized nickel precipitate from solution, and contacting the mainstream solution with said oxidized precipitate for a time sufficient to oxidize cobaltous ions in said solution to the cobaltic state and thus precipitate the cobalt from solution and reduce the nickelic ion to the nickelous state, the temperature of oxidation being over 15°C, whereby the nickel in the mainstream solution is enriched substantially relative to the cobalt to provide a nickel:cobalt ratio in said solution of over 2000:1.

2. The method of claim 1, wherein said nickelous precipitate is oxidized chemically to the nickelic state by contacting it with an oxidizing agent selected from the group consisting of NaOCl, $CaOCl_2$, $(NH_4)_2S_2O_8$ and ozone, or by oxidizing said precipitate electrolytically by passing a suspension of said precipitate in an electrolyte between the electrodes of an electrolytic cell, said oxidation being carried out at a temperature ranging from about 60°C to 90°C for chemical oxidation and about 15°C to 30°C for electrolytic oxidation.

* * * * *